United States Patent [19]

Stasko

[11] 4,070,721

[45] Jan. 31, 1978

[54] SAFETY ATTACHMENT FOR INVALID LIFT AND TRANSPORT APPARATUS

[76] Inventor: William Stasko, 1058 Boyd Ave., Johnstown, Pa. 15905

[21] Appl. No.: 735,444

[22] Filed: Oct. 26, 1976

[51] Int. Cl.[2] ..... A61G 1/02

[52] U.S. Cl. ..... 5/89; 5/86

[58] Field of Search ..... 5/81, 86, 87, 89; 128/134; 182/3, 7; 214/75 H, 280; 297/384, 385

[56] References Cited

U.S. PATENT DOCUMENTS

| | | | |
|---|---|---|---|
| 1,641,952 | 9/1927 | Abraham | 297/385 |
| 2,793,768 | 5/1957 | Schaedler | 5/89 |
| 2,846,745 | 8/1958 | Lathrop | 297/385 |
| 3,137,011 | 6/1964 | Fischer | 5/86 |
| 3,234,568 | 2/1966 | Fischer | 5/89 |
| 3,321,247 | 5/1967 | Dillender | 182/3 |

*Primary Examiner*—Casmir A. Nunberg
*Attorney, Agent, or Firm*—B. P. Fishburne, Jr.

[57] ABSTRACT

The flexible patient supporting sling of an invalid lift and transport device is equipped with a safety strap attachment having a separable buckle. A lower section of the safety strap attachment is permanently stitched to the sling near the forward edge of the sling and a suspension loop on the upper section of the safety strap engages the overhead sling hanger carried by the lift. The attachment makes the sling more secure, prevents the patient from falling out of the front of the sling during transport and suspends the patient safely in the event that the sling suspension hooks at the front of the sling become disconnected.

3 Claims, 4 Drawing Figures

SAFETY ATTACHMENT FOR INVALID LIFT AND TRANSPORT APPARATUS

BACKGROUND OF THE INVENTION

In recent times, invalid lifting and transporting cranes have become widely used in hospitals and nursing homes for the safe lifting and transporting of patients. Customarily, the crane or lifting apparatus includes a flexible fabric sling which is suspended from a hanger attached to the crane boom. Within this sling, the patient can be supported and transported in a semi-prone or sitting position, depending upon the placement of the patient in the sling. In certain circumstances, it is possible with the prior art apparatus for the invalid patient to fall out of the sling in a forward direction and this has resulted in injury.

The objective of the present invention is to improve upon the prior art in terms of safety and security of the patient by providing, on the patient supporting sling, a front generally vertical safety strap attachment which will eliminate the possibility of the patient falling forwardly while being transported and will generally make the sling more secure. A further advantage of the invention is that, in the event that the forward sling support hooks or one such hook should become disconnected from the sling, the patient will not slide or fall completely out of the sling but will be safely suspended by means of the front strap attachment until corrective measures can be taken. The strap attachment has a separate buckle to facilitate placing the patient in the sling and removing him or her therefrom.

Some examples of the patented prior art pertaining to invalid lifting and transporting apparatus are U.S. Pat. Nos. 2,663,031; 2,680,855; 2,903,238 and 3,469,269.

Other features and advantages of the invention will become apparent during the course of the following detailed description.

DETAILED DESCRIPTION

Figure 1:
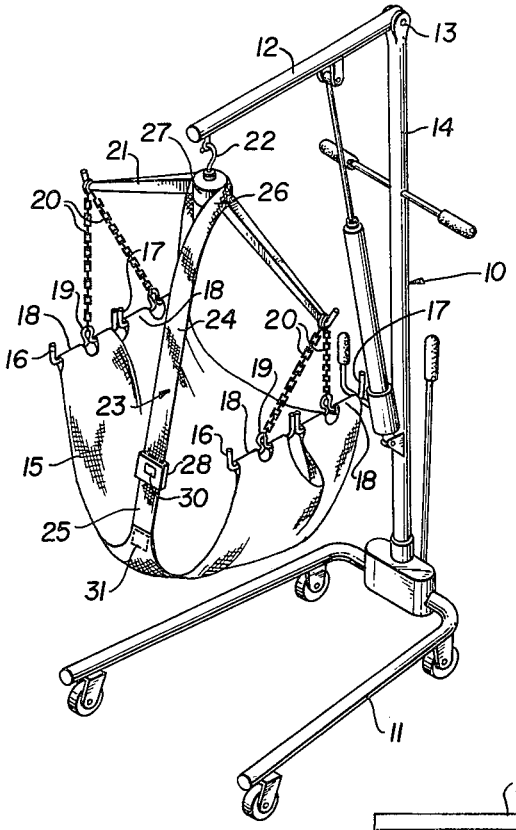
FIG. 1 is a perspective view of an invalid lift and transport apparatus having the invention applied thereto.

Referring to the drawings in detail wherein like numerals designate like parts, the numeral 10 designates a conventional patient lift or crane having a wheeled horizontal base 11 and a vertically adjustable generally horizontal boom 12 having its rear end pivoted at 13 to an upright post 14 rising from the base 11. The details of the crane 10 are well known and need not be further described.

The customary patient support sling 15 is formed of canvas or other flexible sheet material and is suspended at its opposite sides by pairs of front and back hooks 16 and 17 which are received by tubular hems 18 on the opposite sides of the sling body. Customarily, and in the absence of the present invention, the patient sling as described when unloaded constitutes a rather short hammock-like support which is open at the front and back and supported at its two sides. The fore and aft suspension hooks 16 and 17 have suspension eyes 19 at their centers, connected with sturdy suspension chains 20, which chains are in turn supported by the opposite ends of a sling hanger 21 supported near the front of the crane boom 12 by a center hook 22.

Figure 4:
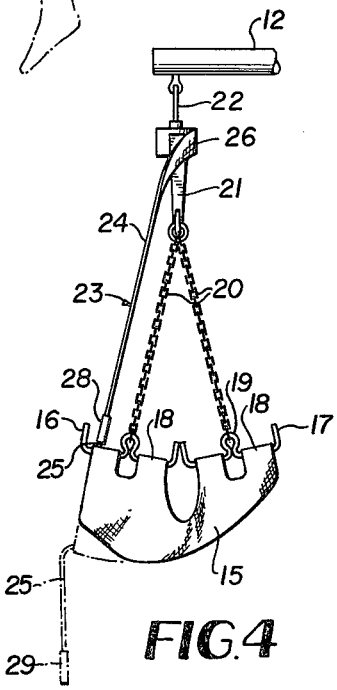
FIG. 4 is a side elevation of the invention as illustrated in FIG. 1 and with the lower safety strap section shown separated in broken lines.

The invention herein is a safety attachment on the flexible sling 15 which eliminates the possibility of the patient falling out of the front of the sling while being transported and also serves to prevent dropping of the patient in the event that one or both front suspension hooks 16 or a rear suspension hook should become disconnected from the sling. The attachment is in the form of a safety strap 23, comprising a relatively long upper section 24 and a relatively short lower section 25. The two sections 24 and 25 have fixed lengths. The upper section 24 has a strong suspension loop 26 formed at its top end and this loop engages about a center hub 27 of the hanger 21, as illustrated. At its bottom end, the strap section 24 carries the female component 28 of a quick-release strap buckle of the type commonly employed on automobile safety lap belts. The coacting male buckle tongue 29, FIG. 4, is attached to the free end of the lower strap section 25 and enters the bottom of the component 28 in the usual manner. The two part buckle is opened at desired times by depressing a quick-release button 30.

The lower end of short strap section 25 is securely stitched as at 31 to the sling 15 at the transverse center thereof and near its forward edge, as illustrated. When the two part buckle is connected and the sling 15 is unloaded, FIGS. 1 and 4, with all four of the suspension hooks 16 and 17 attached to the sling, the sling will assume approximately the form shown in FIGS. 1 and 2, namely, a bucket-like configuration or seat. When a patient is able to sit upright, this bucket shape for the sling 15 will be maintained and the generally vertical safety strap 23 at the front of the seat will guard against the patient falling forwardly during transport.

Figure 3:
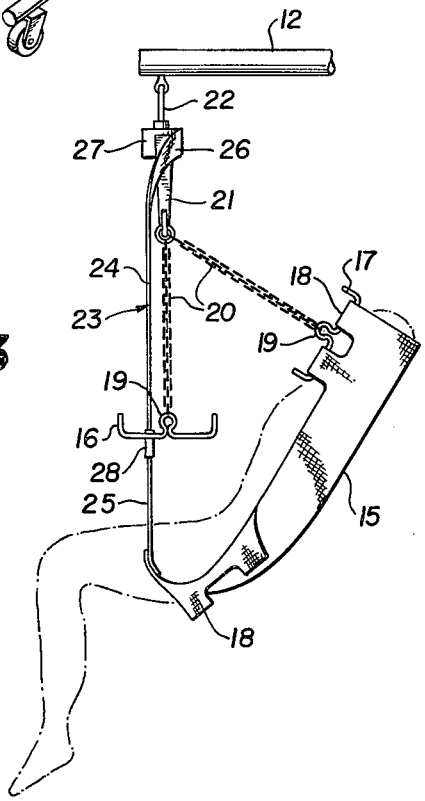
FIG. 3 is a similar side elevation of the invention in a further use configuration.

Should a hook or pair of hooks 16 become accidentally separated from the sling 15, as illustrated in FIG. 3, the strap attachment 23 will prevent the dropping of the patient or the sliding of the patient from the lower end of the sling which will tend to assume a nearly vertical position. Since the patient's legs straddle the strap 23, he or she will be prevented from sliding completely out of the sling and the necessary corrective measures can be taken by an attendant.

Figure 2:
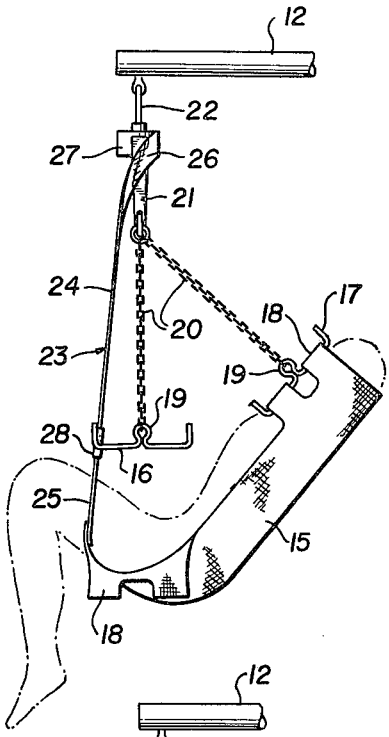
FIG. 2 is a side elevation of the invention in one use configuration.

As shown in FIG. 2, the invention has further utility in allowing an invalid patient to be transported in a semi-prone position. To achieve this position, the front suspension hooks 16 are purposely disconnected and the patient is placed in the sling 15 and adjusted to the illustrated position. The sling 15 and the coacting safety strap 23 will hold the patient in the semi-prone position with safety and comfort.

It may be understood, in view of the foregoing description, that a permanent two-part frontal safety strap attachment is provided on an invalid lift and transport apparatus, with the lower section of the strap permanently secured to the front center of the sling and the upper strap section suspended from the sling hanger of the lift or crane. The construction is simple and convenient to use and, due to the separable buckle, does not interfere with the placement and removal of the patient in the usual manner. Furthermore, the invention does not preclude using the sling without the safety attachment, should this be desirable in some cases. In such cases, the buckle is simply opened and the sling is used without the safety advantage. No change in the construction of the customary apparatus is required except for the minor change involved in stitching the lower strap section 25 to the sling. The cost involved in utilizing the safety attachment is minimal and the advantage of the invention over the prior art in terms of patient security is significant.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. In an invalid lift and transport apparatus, a mobile support, a hanger element on the support, a flexible patient support sling suspended at its sides from said hanger element, a flexible safety strap attachment for the front of the sling having a lower end permanently secured to the sling near its forward edge and transverse center, said strap attachment having an upper end secured to said hanger element, said strap attachment arresting forward displacement of a patient being supported in said sling, said safety strap attachment formed in two separable sections, a quick coupling and release buckle joining said sections, said separable strap sections comprising a relatively short lower strap section permanently secured to said sling and an upper relatively long strap section secured to said hanger element, and said upper strap section having a top end loop adapted to embrace a center hub of the hanger element to thereby suspend the upper strap section from the center of the hanger element and above the center of the sling.

2. In an invalid lift and transport apparatus, a mobile support, a hanger element on the support, a flexible patient support sling suspended at its sides from said hanger element, a flexible safety strap attachment for the front of the sling having a lower end permanently secured to the sling near its forward edge and transverse center, said safety strap attachment having an upper end secured to the hanger element, said safety strap attachment arresting forward displacement of a patient being supported in the sling, and front and rear side suspension hooks for said patient support sling, and flexible suspension elements interconnecting said hooks with opposite end of said hanger element, the hanger element having its ends substantially above the opposite sides of the sling, whereby the sides of the sling are supported in spaced relationship with said safety strap attachment approximately midway therebetween at the front of the sling so that the legs of a supported patient in the sling can straddle the safety strap attachment.

3. In an invalid lift and transport apparatus as defined in claim 2, and said suspension hooks being separably connected with said sling.

* * * * *